US006279706B1

(12) United States Patent
Mao

(10) Patent No.: US 6,279,706 B1
(45) Date of Patent: Aug. 28, 2001

(54) PULL ROD OF LUGGAGE CAPABLE CARRIED ON ONE'S BACK

(76) Inventor: Chen Shou Mao, 344 Section 1, Chung Shan Road, Ta Cha Township, Taichung Hsien (TW)

( * ) Notice: Subject to any disclaimer, the term of this patent is extended or adjusted under 35 U.S.C. 154(b) by 0 days.

(21) Appl. No.: 09/593,301

(22) Filed: Jun. 13, 2000

(51) Int. Cl.[7] ..... A45C 13/26

(52) U.S. Cl. ..... 190/115; 190/18 A; 16/113.1; 224/153

(58) Field of Search ..... 224/153; 16/429, 16/113.1; 190/119, 115

(56) References Cited

U.S. PATENT DOCUMENTS 5,464,080 * 11/1995 Liang ..... 190/115 X
5,464,081 * 11/1995 Zwanzig ..... 190/115
5,469,945 * 11/1995 Jserng ..... 190/115
5,497,865 * 3/1996 Yun-Pi ..... 190/115
5,865,281 * 2/1999 Wang ..... 190/115 X
5,893,495 * 4/1999 Godshaw et al. ..... 190/115
5,908,093 * 6/1999 Miyoshi ..... 190/115
6,041,900 * 3/2000 Sadow et al. ..... 190/115 X

* cited by examiner

*Primary Examiner*—Allan N. Shoap
*Assistant Examiner*—Tri M. Mai
(74) *Attorney, Agent, or Firm*—Harrison & Egbert

(57) ABSTRACT

Luggage having two shoulder straps to facilitate the carrying of the luggage on the back of a person. The luggage is further provided to a pull rod which is fastened at the bottom end with a base located at the bottom of the interior of the luggage. The pull rod is so curved that it is corresponding in curvature to the human spinal cord, thereby preventing the pull rod from causing discomfort to the person's back on which the luggage is carried.

2 Claims, 9 Drawing Sheets

PULL ROD OF LUGGAGE CAPABLE CARRIED ON ONE'S BACK

BACKGROUND OF THE INVENTION

1. Field of the Invention

The present invention relates generally to luggage, and more particularly to a pull rod for luggage.

2. Description of Related Arts

As shown in FIGS. 1 and 2, a prior art luggage 11 is provided with an expandable pull rod 10 and two shoulder straps 12 enabling the luggage 11 to be carried on the back of a person. The pull rod 10 is made of a metal material and is fastened to the back side of the luggage 11. When the luggage 11 is carried on the back of a person, the rigid pull rod 10 often becomes a source of discomfort to the back of the person, especially when the person bends.

BRIEF SUMMARY OF THE INVENTION

The primary objective of the present invention is therefore to provide a luggage pull rod which is free from the deficiency of the luggage pull rod of the prior art described above.

The features and the advantages of the present invention readily appreciated and understood upon a thoughtful deliberation of the following detailed description of a preferred embodiment of the present invention with reference to the accompanying drawings.

DETAILED DESCRIPTION OF THE INVENTION

Figure 8:
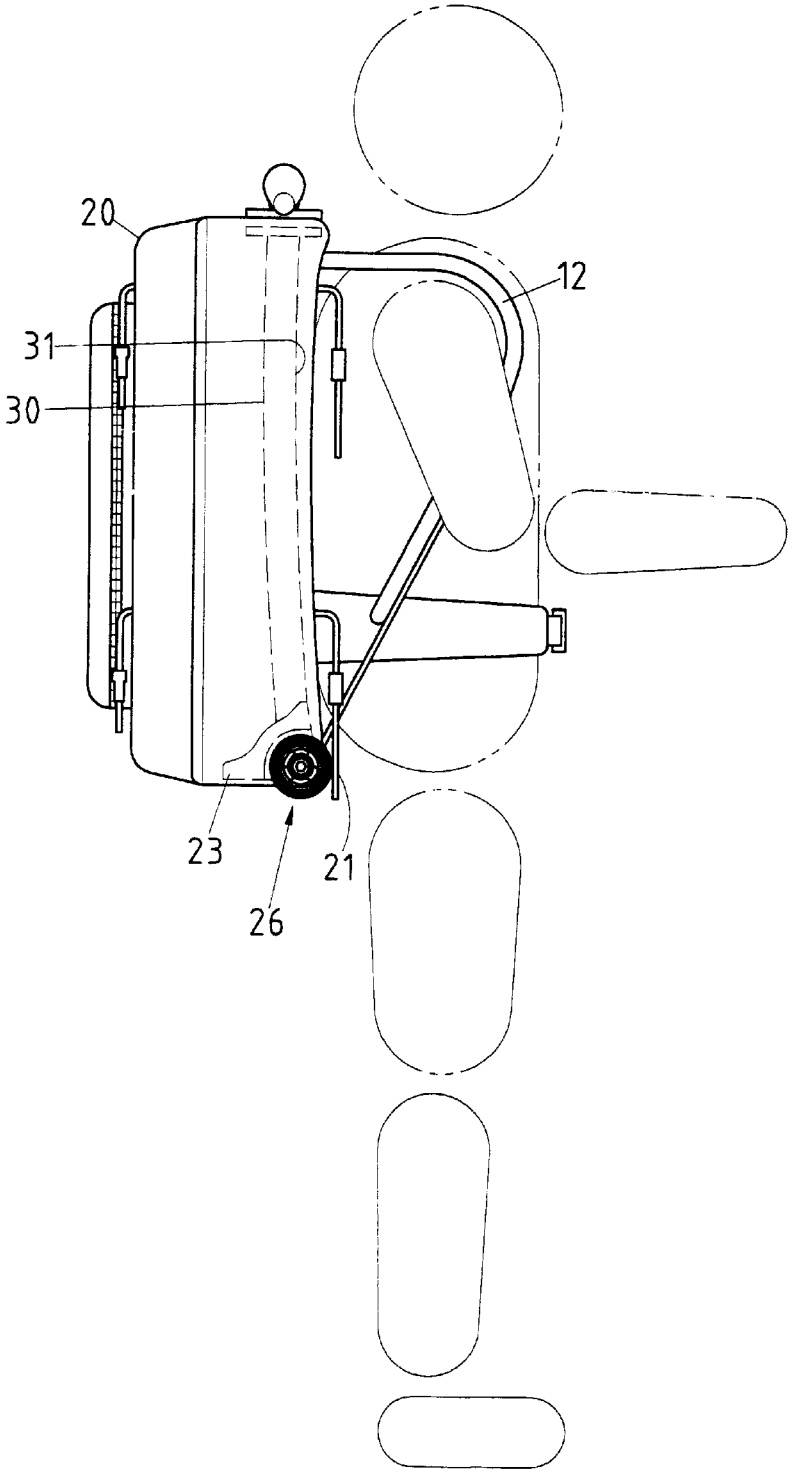
FIG. 8 shows a schematic view of the luggage of the present invention being carried on the back of a person.
Figure 9:
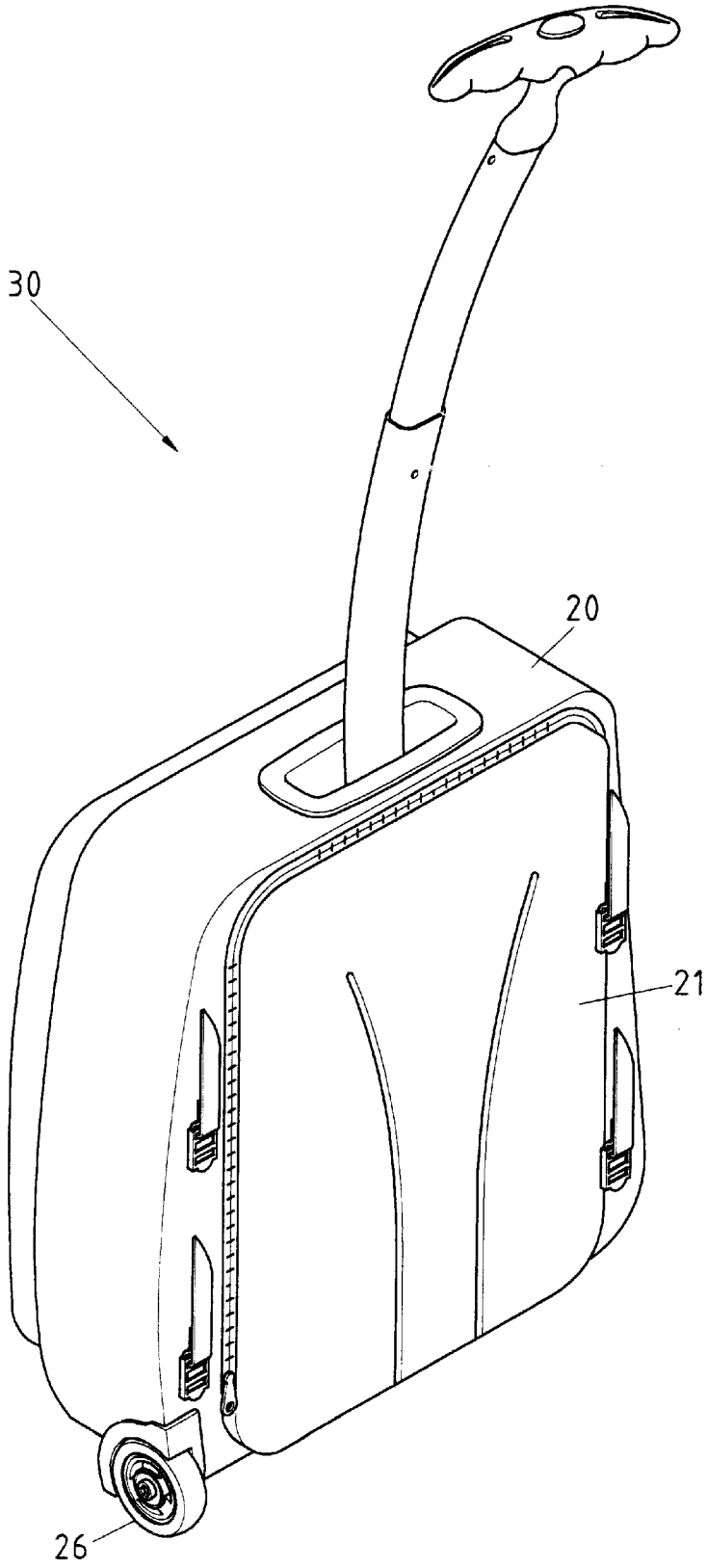
FIG. 9 shows a schematic perspective view of the luggage of the present invention with its pull rod being fully extracted.

As shown in FIGS. 3–9, a luggage 20 of the preferred embodiment of the present invention is provided in the back side thereof with a bag 21, and two shoulder straps 22 enabling the luggage 20 to be carried on the back of a person, as shown in FIG. 8. The luggage 20 is further provided at the bottom of the interior thereof with a base 23 which is provided in the center with a pivoting seat 24 for mounting pivotally a pull rod frame 30. The luggage 20 is provided at the top with a locating piece 25 for locating an arcuate pull rod 31 of the pull rod frame 30. The base 23 is provided at the two longitudinal ends with a caster 26 pivoted thereto.

Figure 1:
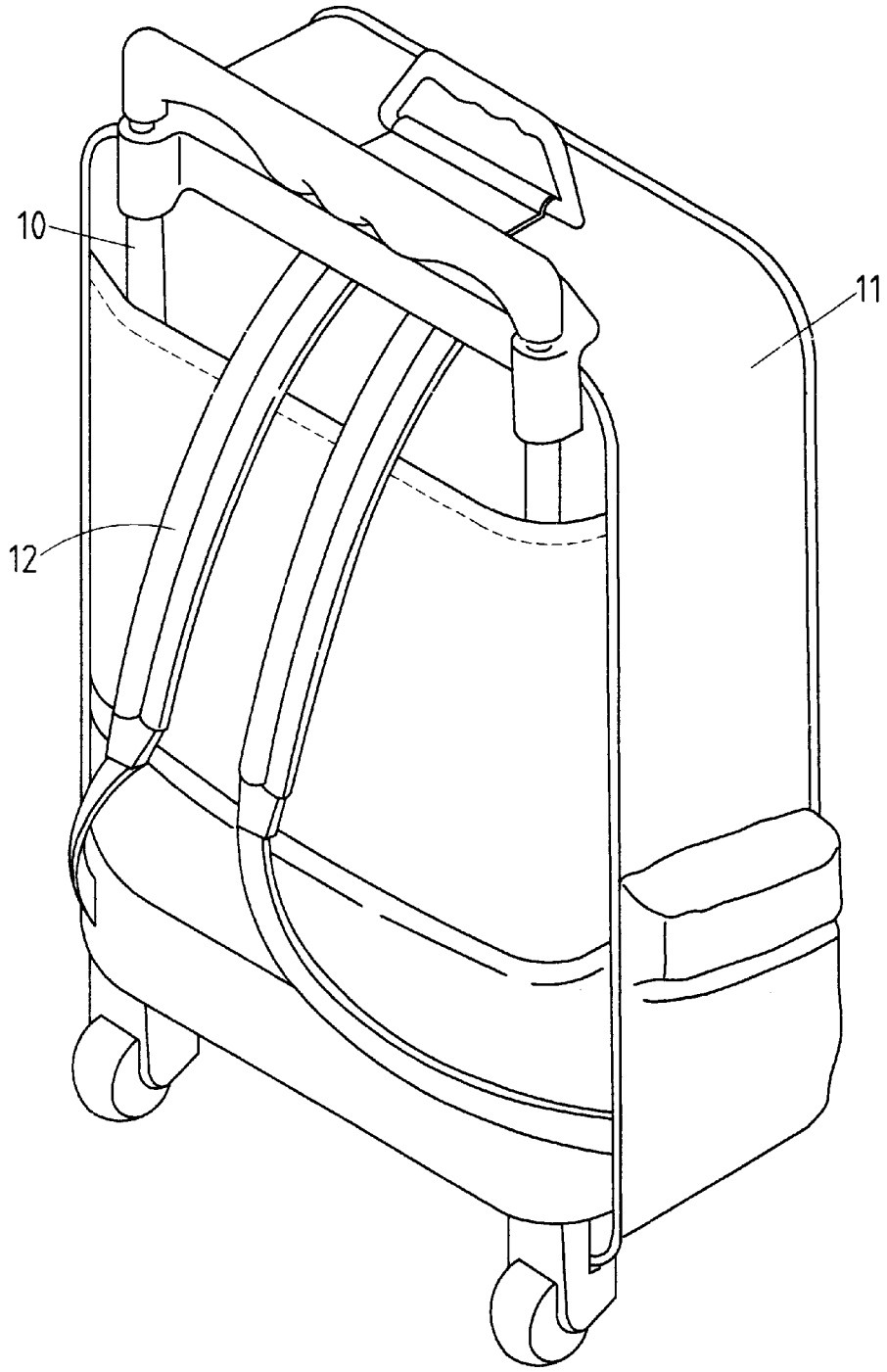
FIG.1 PRIOR ART
FIG. 1 shows a perspective view of a prior art luggage capable of being carried on the back of a person.
Figure 2:
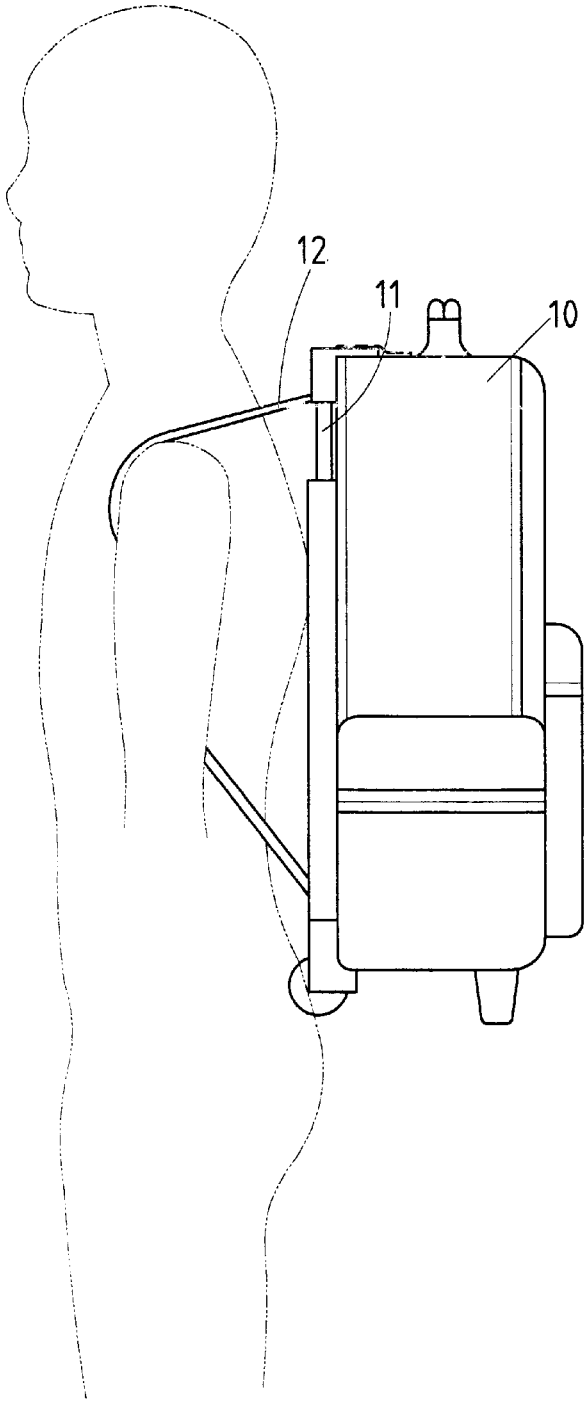
FIG.2 PRIOR ART
FIG. 2 shows a schematic view of the prior art luggage being carried on the back of a person.
Figure 3:
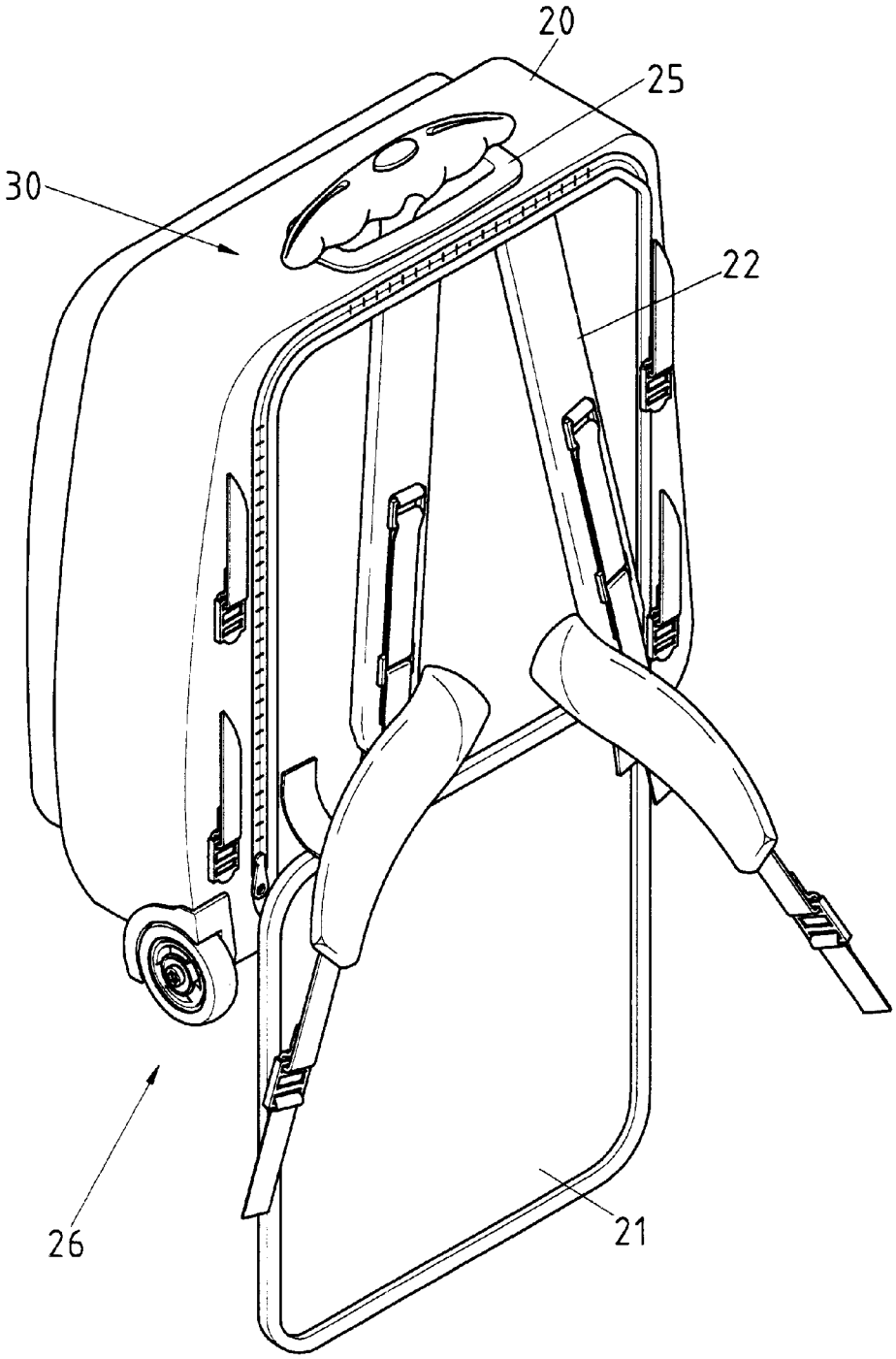
FIG. 3 shows a perspective view of luggage of the preferred embodiment of the present invention.
Figure 4:
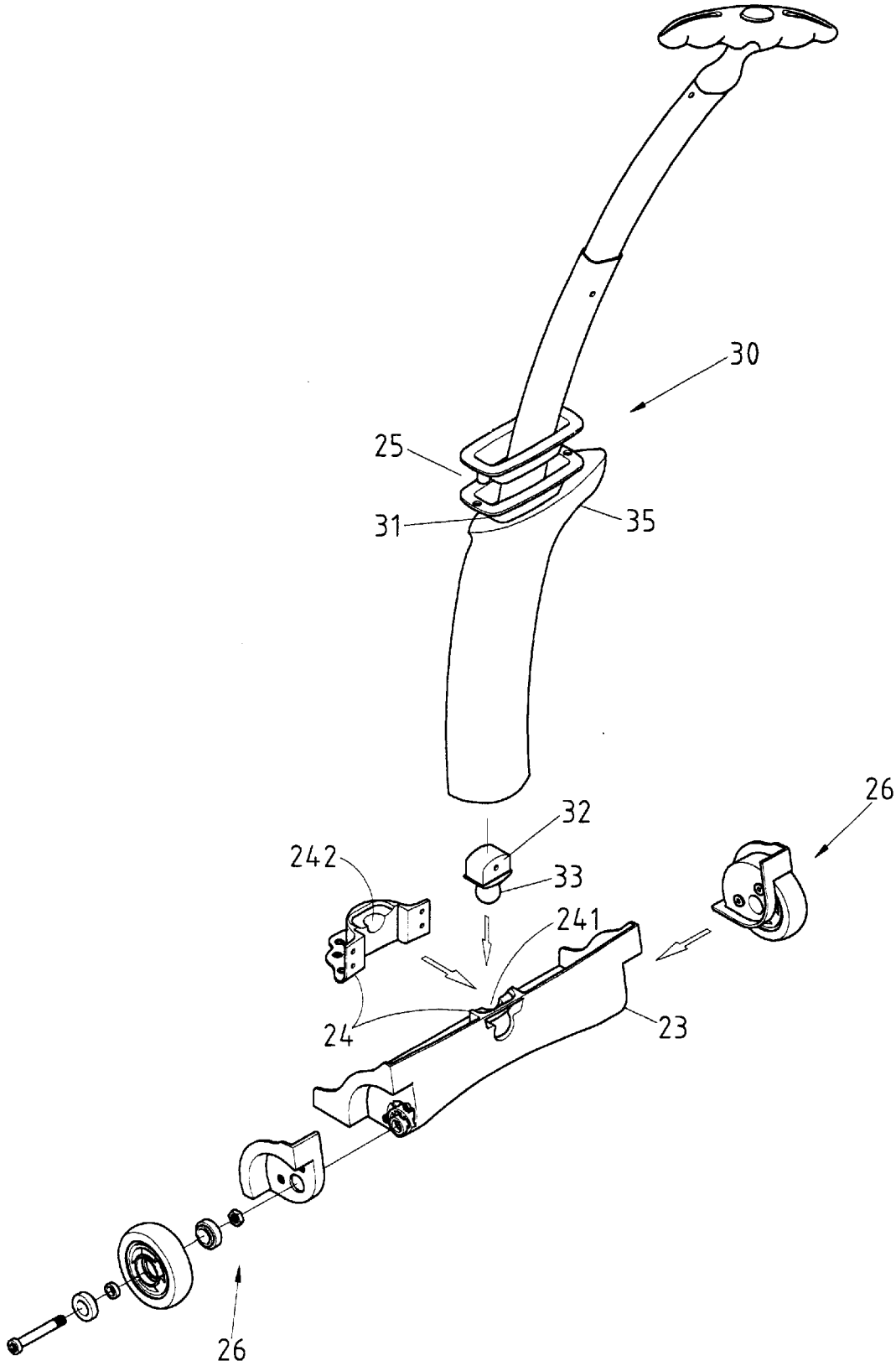
FIG. 4 shows a partial exploded view of the preferred embodiment of the present invention.
Figure 5:
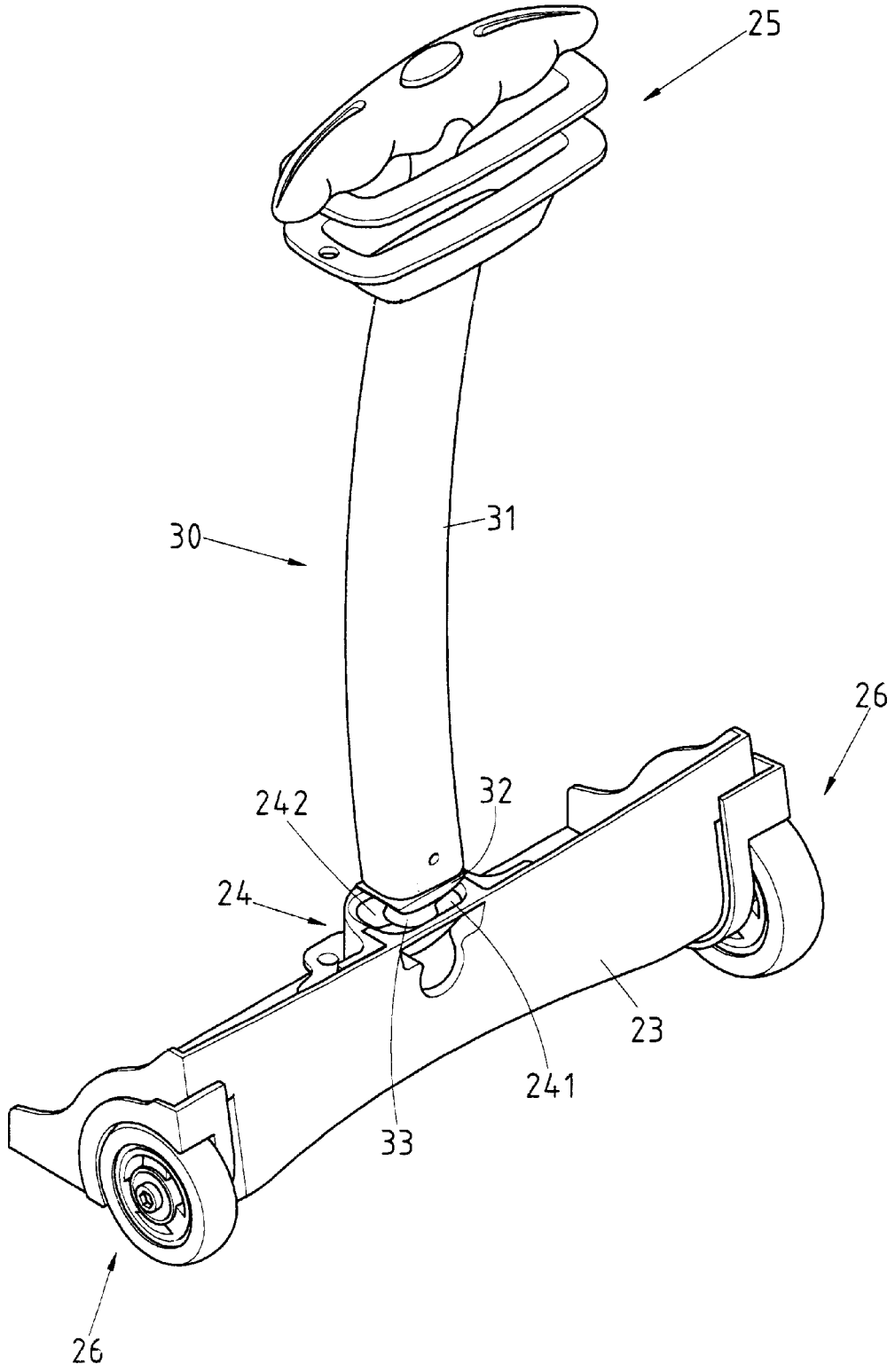
FIG. 5 shows a perspective view of a pull rod frame of the preferred embodiment of the present invention.

As shown in FIG. 4, the pivoting seat 24 is provided with a first receiving slot 241 and a second receiving slot 242. The first receiving slot 241 is made integrally with the pivoting seat 24 and is of a semispherical construction. The second receiving slot 242 is symmetrical in construction to the first receiving slot 241 such that the second receiving slot 242 forms with the first receiving slot 241 a spherical slot for receiving a spherical body 33 of a connection body 32 which is fastened to the bottom end of the pull rod 31. It must be noted that the second receiving slot 242 is independent of the first receiving slot 241 and is fastened to the pivoting seat 24 by a plurality of screws.

Figure 6:
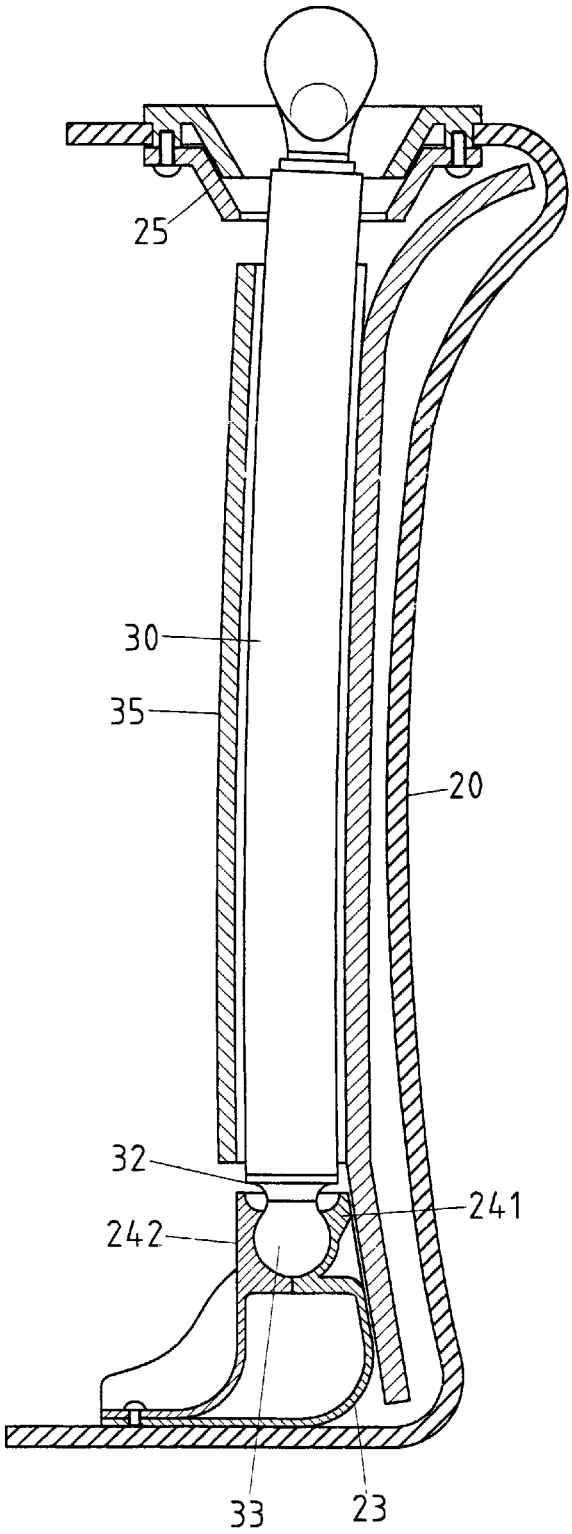
FIG. 6 shows a sectional schematic view of the pull rod frame of the preferred embodiment of the present invention.
Figure 7:
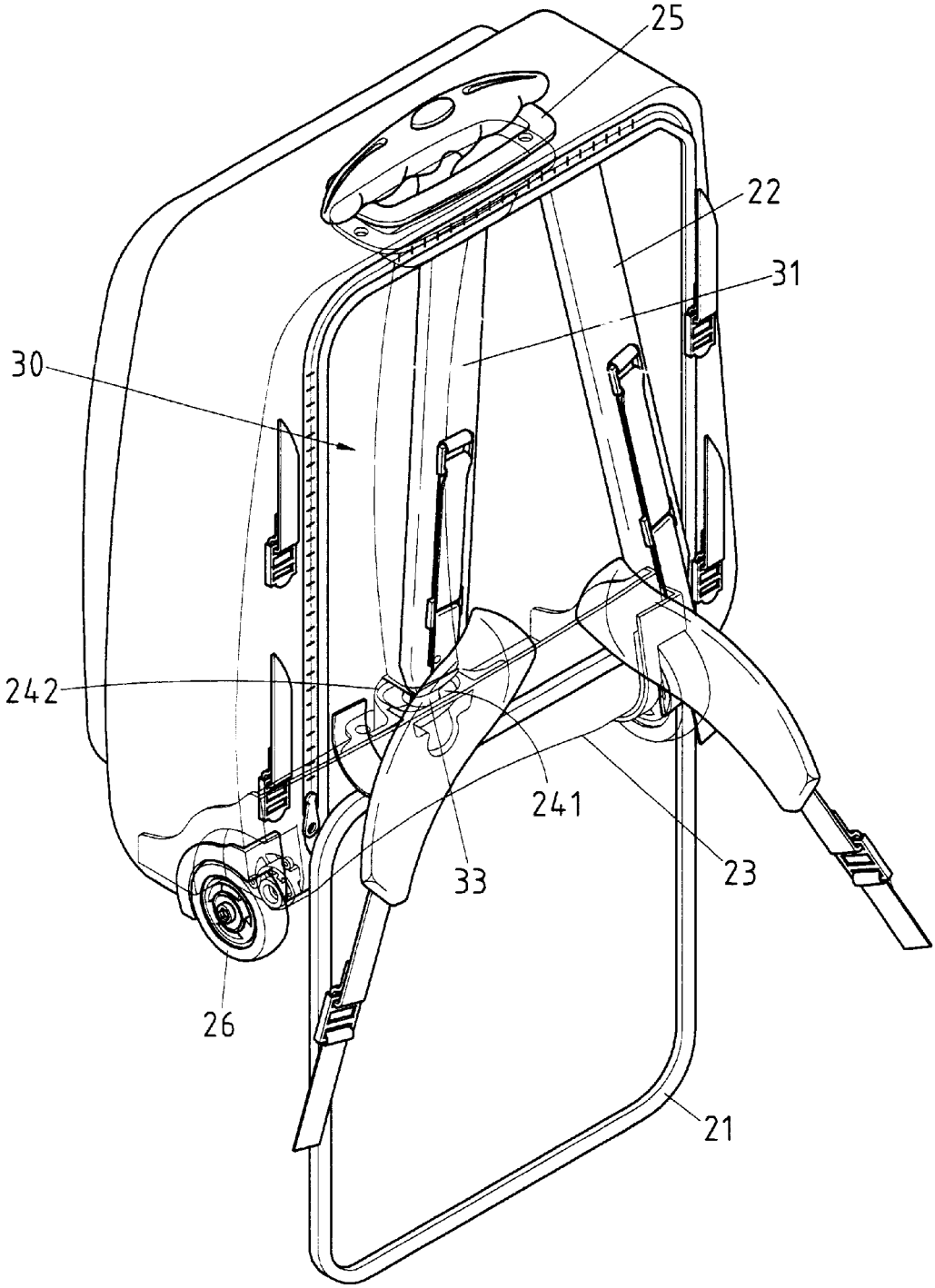
FIG. 7 shows another perspective view of the luggage of the preferred embodiment of the present invention.

As shown in FIG. 6, the pull rod frame 30 is enclosed in a fabric jacket 35 which is fastened to the inside wall of the luggage 20.

In light of the curved pull rod 31 being corresponding in curvature to the human spinal cord, the curved pull rod 31 does not bother a person's back on which the luggage 20 of the present invention is carried. In addition, the fabric jacket 35 serves to provide a cushioning effect to mitigate the discomfort that the pull rod 31 might cause to the person's back.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. An article comprising:

a luggage;

a pair of shoulder straps affixed to said luggage so as to be extendable outwardly therefrom so as to allow said luggage to be carried on a human back;

a base affixed to a bottom of an interior of said luggage, said base having a pivoting seat with a spherical slot, said spherical slot being defined by a first receiving slot and a second receiving slot affixed together; and a pull rod frame having a pull rod telescopically received therein, said pull rod frame and said pull rod being curved along a longitudinal axis thereof so as to conform to a shape of the human back, said pull rod frame having a connection body fastened to a bottom end thereof, said connection body having a spherical body formed thereon, said pull rod frame mounted to said base such that said spherical body is received in said spherical slot of said pivoting seat, said pull rod frame positioned interior of said luggage, said pull rod having a handle affixed thereto, said handle positioned on an exterior of said luggage such that said pull rod is longitudinally slidable outwardly of said pull rod frame.

2. The article of claim 1, further comprising:

a locating piece affixed to a top of said luggage, said pull rod extending through said locating piece.

* * * * *